US006848180B2

(12) United States Patent
Shimizu

(10) Patent No.: US 6,848,180 B2
(45) Date of Patent: Feb. 1, 2005

(54) TURBOCHARGER TURBINE SHAFT JOINING METHOD

(75) Inventor: Masami Shimizu, Chiba (JP)

(73) Assignee: Shimizu Turbo Technology, Chiba (JP)

( * ) Notice: Subject to any disclaimer, the term of this patent is extended or adjusted under 35 U.S.C. 154(b) by 0 days.

(21) Appl. No.: 10/470,696

(22) PCT Filed: Feb. 8, 2002

(86) PCT No.: PCT/JP02/01091

§ 371 (c)(1),
(2), (4) Date: Jul. 30, 2003

(87) PCT Pub. No.: WO02/064959

PCT Pub. Date: Aug. 22, 2002

(65) Prior Publication Data

US 2004/0057834 A1 Mar. 25, 2004

(30) Foreign Application Priority Data

Feb. 9, 2001 (JP) ..... 2001-034439

(51) Int. Cl.[7] ..... F01D 5/02
(52) U.S. Cl. ..... 29/889.2; 416/213 R; 416/244 R
(58) Field of Search ..... 416/213 R, 244 R; 29/889.2

(56) References Cited

U.S. PATENT DOCUMENTS 4,983,064 A * 1/1991 Kawaguchi et al. ..... 403/30
5,084,329 A * 1/1992 Kato et al. ..... 428/212

FOREIGN PATENT DOCUMENTS

| | | |
|---|---|---|
| JP | U 64-41633 | 3/1989 |
| JP | A 2-173322 | 7/1990 |
| JP | A 2001-254627 | 9/2001 |

* cited by examiner

*Primary Examiner*—Ninh H. Nguyen
(74) *Attorney, Agent, or Firm*—Oliff & Berridge, PLC

(57) ABSTRACT

A joining method providing improved joining accuracy for wheel and turbine shaft. A part of the inner peripheral wall of a fitting hole of a wheel is tapered inwardly from the opening of the fitting hole. At one end of the turbine shaft to be joined to the wheel, a tapered axial abutment portion is provided. In the turbine shaft, an axial abutment portion is provided in a part other than the portion to be fused by welding to suppress deformation at the time of fusion. The axial abutment portion is tapered, and the inner peripheral wall of the fitting hole is tapered, whereby the wheel and the turbine shaft are brought into close contact with each other while positioned coaxially. As such, close contact is effected in a stable manner in the axial abutment portion where tapered surfaces come into contact with each other.

14 Claims, 7 Drawing Sheets

TURBOCHARGER TURBINE SHAFT JOINING METHOD

TECHNICAL FIELD

The present invention relates to a method of joining wheels (turbine wheel and compressor wheel) and a turbine shaft used in a supercharger (turbocharger) of an internal combustion engine.

BACKGROUND ART

Regarding an internal combustion engine mounted in an automobile or the like, a technique is known according to which a turbocharger for compressing intake air is provided in order to achieve an improvement in charging efficiency to thereby improve the engine output. Generally speaking, such a turbocharger is driven by utilizing the energy of exhaust gas discharged from the internal combustion engine.

In a turbocharger, a turbine housing provided at some midpoint in an exhaust passage and a compressor housing provided at some midpoint in an intake passage are connected to each other through the intermediation of a center housing, and a turbine wheel rotatably supported in the turbine housing and a compressor wheel rotatably supported in the compressor housing are coaxially connected through the intermediation of a turbine shaft rotatably supported in the center housing.

In such a turbocharger, exhaust gas discharged from the internal combustion engine flows into the turbine housing through an exhaust inlet, and this exhaust gas flows along a scroll passage in an eddy-like fashion. Then, it flows from the scroll passage to a nozzle passage before it is blown against the turbine wheel to thereby rotate the turbine wheel.

When the turbine wheel is thus rotated, the torque of the turbine wheel is transmitted to the compressor wheel through the turbine shaft, and the compressor wheel rotates in synchronism with the turbine wheel. When the compressor wheel rotates in synchronism with the turbine wheel, the intake air in the vicinity of the intake air inlet is sucked in the compressor housing by a sucking force generated by the rotation of the compressor wheel and sent under pressure to an intake air outlet by way of a send-out passage and the scroll passage.

Thus, the intake air compressed in the compressor housing is forcibly supplied to the combustion chamber, so that the charging efficiency of the intake air is improved. In this process, the fuel injection amount is increased in response to the increase in the intake air amount, whereby it is possible to obtain larger combustion power and explosive power, making it possible to enhance the engine output.

At this time, the turbine wheel must rotate at a high speed of from 100,000 to 160,000/min. while being exposed to exhaust with a maximum temperature as high as 900° C. Thus, in the production of a turbocharger, the turbine wheel, the compressor wheel, and the turbine shaft must be arranged with high accuracy in the same rotation axis. In particular, it is very important that no production error (deviation in rotation axis of the wheel and the turbine shaft) should be generated when joining them together.

Conventionally, the wheel and the turbine shaft are often joined by electron beam welding; in this case, the product accuracy depends on the accuracy with which the pre-welding processing (edge preparation) is performed.

Conventionally, this edge preparation has been performed as follows.

First, as shown in FIG. 9, a fitting hole 51 is formed in a turbine wheel 50, and a protrusion 61 is formed at one end of one turbine shaft 60 on the side joined to the turbine wheel 50. This protrusion 61 is fitted into the fitting hole 51 so as to generate a gap portion 52, and one end of the turbine shaft 60 is abutted against the turbine wheel 50 at an abutment portion 53 to perform positioning.

In another method, the turbine wheel and the turbine shaft are abutted against each other, and positioning is performed in a condition in which they are secured by a welding jig.

Of those conventional methods, the former method requires provision of a clearance at the fitting portion 52 taking into account the deformation at the time of welding, etc., so that, due to the play, it is rather difficult to secure the coaxiality of the turbine wheel 50 and the turbine shaft 60.

Further, at the time of joining, the entire periphery of the abutment portion 53 is fused by electron beam welding or the like, and the fusion of the abutment portion 53 is likely to lead to bending deformation at this portion.

Further, since the turbine shaft 60 is contracted in the axial direction, a problem occurs such as the dimensional accuracy in the axial direction is likely to be lost.

In the latter method, the positioning of the turbine wheel 50 and the turbine shaft 60 depends upon the accuracy of the jig used, so that it is rather difficult to secure stable coaxiality. Further, due to the variation in the jig and secular change, it is difficult to maintain accurate coaxiality.

In addition, as in the former method, the entire abutment portion of the turbine wheel and the turbine shaft is fused by electron beam welding or the like so that bending deformation is likely to occur at this portion. Further, since the turbine shaft contracts in the axial direction, a problem occurs such as the dimensional accuracy in the axial direction is likely to be lost.

In particular, in the above conventional methods, a part of the turbine shaft (abutment portion 53) is fused by welding, so that the turbine shaft 60 contracts. In view of this, the turbine wheel 50 and the turbine shaft 60 are first welded, and, thereafter, as shown in FIG. 10, adjustment of the bending of the shaft main body of the turbine shaft 60 and minute processing of the thrust bearing, etc. provided at one end thereof must be executed for improvement in general accuracy. Specifically, after welding the structure with a contour as indicated by the solid line in FIG. 10, this turbine shaft 60 has to be cut into the shape as indicated by the two-dot chain line, executing adjustment of the axis and minute processing of the thrust bearing, etc. Thus, as compared with the case in which processing is performed solely on the turbine shaft 60 before welding, the processing is hard to perform and requires a lot of time.

The present invention has been made in view of the above problems. It is a technical object of the present invention to provide a joining method which makes it possible to achieve an improvement in the joining accuracy for the wheel and the turbine shaft.

DISCLOSURE OF THE INVENTION

In order to achieve the above-mentioned object, according to the present invention, the following measures are employed.

That is, in a turbocharger turbine shaft joining method for joining together a wheel having a fitting hole into which one end portion of a turbine shaft is to be inserted for fixation and a turbine shaft to be positioned concentrically to a rotation axis of the wheel, the method is characterized in that at least a part of an inner peripheral wall of the fitting hole of the wheel is tapered so as to be reduced in diameter inwardly from the opening of the fitting hole, that provided at one end of the turbine shaft to be joined to the wheel are a tapered axial abutment portion capable of being brought into close contact with the tapered inner peripheral wall and an insertion portion with a fixed diameter to be inserted into the fitting hole, and that the wheel and the turbine shaft are joined and fixed to each other so as to be coaxial in the rotation axis.

In the method, it is possible to be constructed such that an insertion portion with a fixed diameter is formed at one end of the turbine shaft, and a tapered portion is provided, which is connected to the insertion portion and gradually increased in diameter from the insertion portion, whereby the insertion portion and a larger diameter portion being coaxially arranged.

In this case, the wheels include a turbine wheel, compressor wheel, etc. which are coaxially connected together through the intermediation of a turbine shaft which is rotatably supported.

Also, it is possible to be constructed such that the wheel and the turbine shaft are welded to each other by fusing a part other than the axial abutment portion of the turbine shaft and the tapered inner peripheral wall of the wheel.

It is preferable for the turbine wheel used in the above method that at least a part of the inner peripheral wall of the fitting hole into which one end portion of the turbine shaft is to be inserted is tapered so as to reduce in diameter inwardly from the opening of the fitting hole.

Here, the turbine shaft adapts such a structure that provided at one end of the turbine shaft are a tapered axial abutment portion capable of being brought into close contact with the tapered inner peripheral wall of the fitting hole formed in the turbine wheel and an insertion portion with a fixed diameter to be inserted into the fitting hole. In this case, it is possible to have such a structure that an insertion portion with a fixed diameter is formed at one end of the turbine shaft, and that a tapered portion connected to the insertion portion and gradually increasing in diameter is provided, whereby the insertion portion and the tapered portion being arranged coaxially.

It is possible to apply the turbocharger of the present invention to the production of all manner of turbochargers, such as variable turbo, combustible nozzle turbo, linear chassis turbo, and sequential turbo, as long as it is of the type having wheels and a turbine shaft.

In the present invention, it is possible to be constructed such that an axial abutment portion is provided in a part other than the portion of the turbine shaft fused by welding, so that it is possible to prevent change in axial dimension when the turbine shaft undergoes fusion contraction.

Further, it is possible to be constructed such that the axial abutment portion is formed in a tapered configuration, and on the other hand, at least a part of the inner peripheral wall of the fitting wall coming into contact therewith is also formed in a tapered configuration, whereby the wheel and the turbine shaft are brought into close contact with each other without fail, and they are guided so as to be positioned coaxially, thereby making it possible to easily secure accuracy in coaxiality.

Further, it is possible to be constructed such that, in addition to the axial abutment portion, there is provided an insertion portion having a fixed diameter, thereby stabilizing the close contact property of the axial abutment portion where tapered surfaces come into contact with each other.

At the same time, due to the tapered axial abutment portion, the movement in the direction perpendicular to the axial direction of the turbine shaft is restricted, so that it is possible to prevent the turbine shaft from being bent by the heat at the time of welding.

It is possible to be constructed such that, in addition to the axial abutment portion, the turbine shaft can have, at a position other than the portion fused by welding, an abutment portion which abuts a surface formed in the fitting hole and which restricts axial movement of the turbine shaft at the time of welding, whereby displacement of the turbine shaft is reliably prevented.

In the method, it is possible to be constructed such that an insertion portion with a fixed diameter to be inserted into the fixing hole is provided at one end of the turbine shaft to be joined to the wheel instead of providing the tapered axial abutment portion, and that provided on the insertion portion is an abutment portion abutting against a surface formed in the fitting hole and restricting axial movement of the turbine shaft, so that it is possible to prevent axial movement of the turbine shaft at the time of welding.

In the present invention, when joining together the wheel and the turbine shaft by a means such as welding, it is possible to prevent change in dimension due to axial contraction of the turbine shaft 4, thereby making it possible to achieve an improvement in product accuracy.

In particular, when joining together the wheel equipped with a fitting hole into which one end portion of the turbine shaft is to be inserted for fixation and the turbine shaft to be positioned in the rotation axis of this wheel, it is possible to be constructed such that at least a part of the inner peripheral wall of the fitting hole of the wheel is tapered inwardly from the opening of the fitting hole, and on the other hand, at one end of the turbine shaft to be joined to the wheel, there are provided a tapered axial abutment portion capable of coming into close contact with the inner peripheral wall and an insertion portion to be inserted into the fitting hole and having a fixed diameter, whereby the wheel and the turbine shaft can be easily arranged coaxially, thereby simplifying the processing step and achieving an improvement in product accuracy.

BEST MODE FOR CARRYING OUT THE INVENTION

Embodiments of the turbocharger turbine shaft joining method of the present invention will now be described with reference to the drawings.

Embodiment 1

Figure 7:
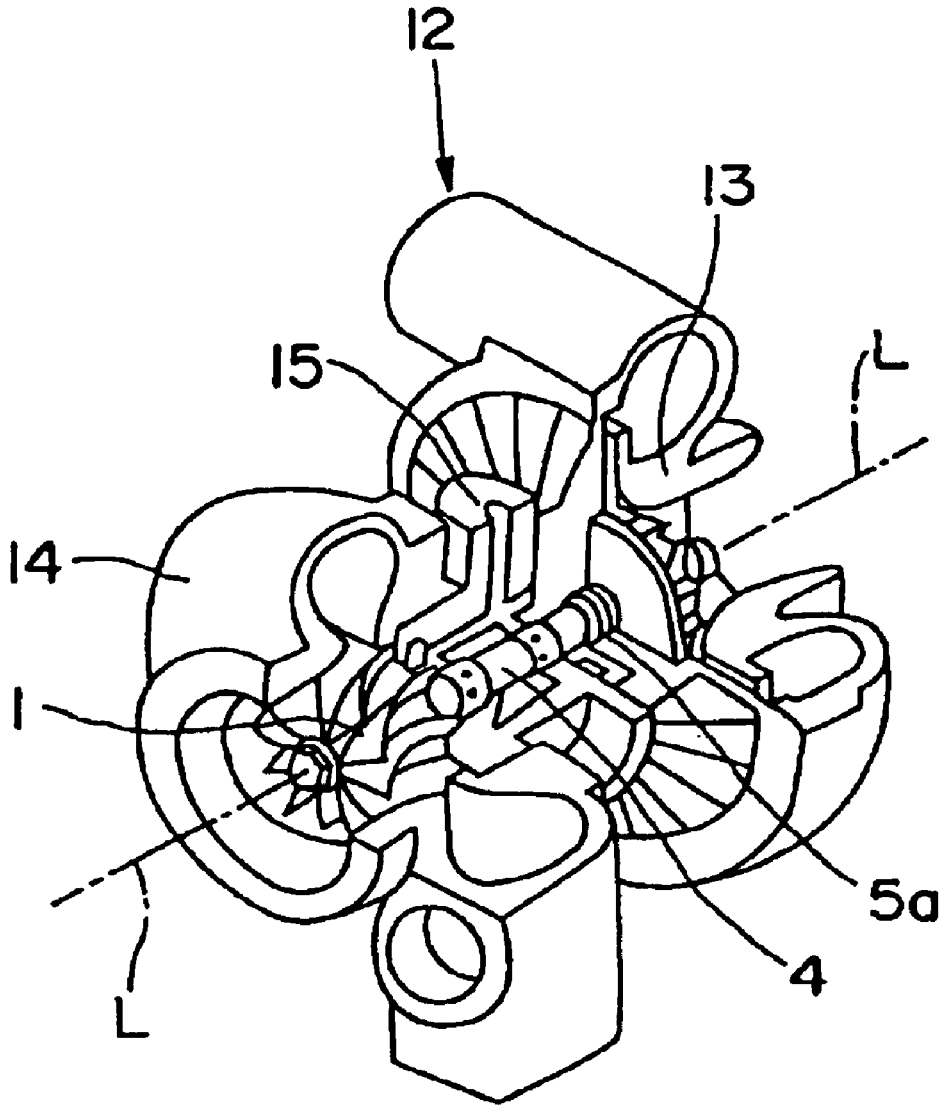
FIG. 7 is a perspective view, partially broken away, showing the construction of a turbocharger.

As shown in FIG. 7, in a turbocharger 12, a compressor housing 13 and a turbine housing 14 are connected to each other through the intermediation of a center housing 15; in the center housing 15, a turbine shaft 4 is supported so as to be rotatable around its axis L. One end portion of the turbine shaft 4 protrudes into the compressor housing, and a turbine wheel 1 equipped with a plurality of blades 2 is mounted to the protruding portion.

In the following, the method of joining together the turbine shaft 4 and the turbine wheel 1, used in the turbocharger 12 constructed as described above, will be described in detail.

(Edge Preparation for Turbine Wheel)

Figure 1:
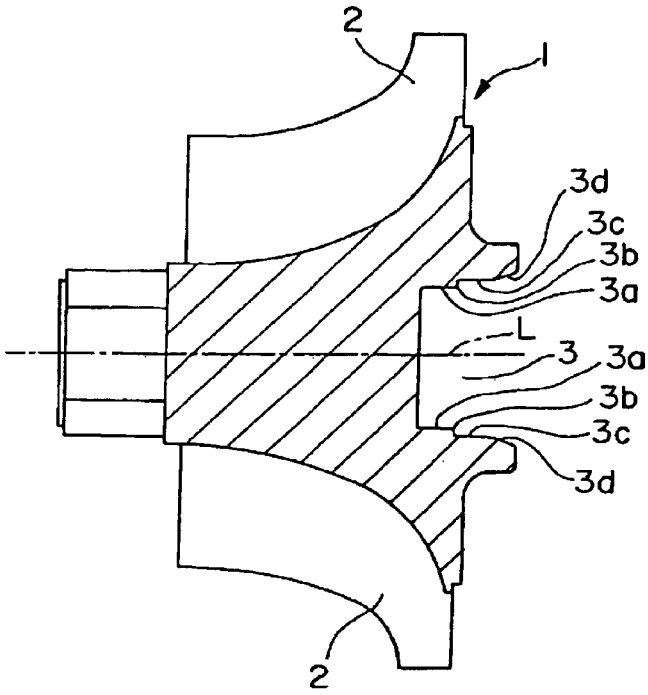
FIG. 1 is a sectional view of a turbine wheel according to the present invention.

The turbine wheel 1, which is rotated by the force of exhaust flow, has blades 2 formed around a cylindrical main body. As shown in FIG. 1, in the rotation axis L, there is provided a cylindrical fitting hole 3 into which the turbine shaft 4 is inserted for fixation. An inner peripheral wall 3*a* of the fitting hole 3 is equipped with a step portion 3*b*, and the entire periphery of the inner peripheral wall extending from the step portion 3*b* toward the opening of the fitting hole 3 constitutes a large diameter portion 3*c* whose diameter is larger than that of the forward end portion of the fitting hole 3. The entire periphery of the inner peripheral wall of the portion nearer the opening than the large diameter portion 3*c* is tapered so as to increase in diameter toward the opening, and this portion constitutes a tapered edge portion 3*d*.

An edge preparation as described above is performed on the turbine wheel 1 for connection with the turbine shaft 4 by welding.

Figure 2:
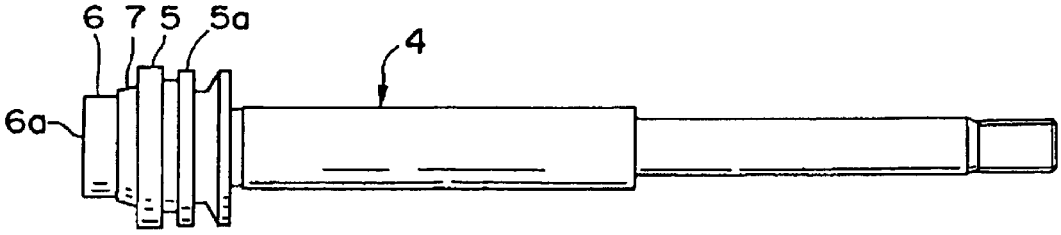
FIG. 2 is a side view of a turbine shaft according to the present invention.

As shown in FIG. 2, the turbine shaft 4 is a cylindrical shaft, at one end of which there is provided a head portion 5 to be inserted into the fitting hole 3 for fixation. The head portion 5 has a larger diameter than the middle portion of the turbine shaft 4 and has a thrust bearing 5*a*, etc.

The forward end portion of the head portion 5 is equipped with an insertion portion 6 with a fixed diameter, i.e., without any change in diameter, and the insertion portion 6 is connected to a tapered axial abutment portion 7 with a gradually increasing diameter, the insertion portion 6 and the axial abutment portion 7 being arranged substantially coaxially.

After being endowed with an approximately proper contour, this turbine shaft 4 undergoes heat treatment for increased hardness, and finish processing through polishing.

(Joining of Turbine Wheel and Turbine Shaft)

Next, a process for joining together the turbine wheel 1 and the turbine shaft 4, processed as described above, will be described.

Figure 3:
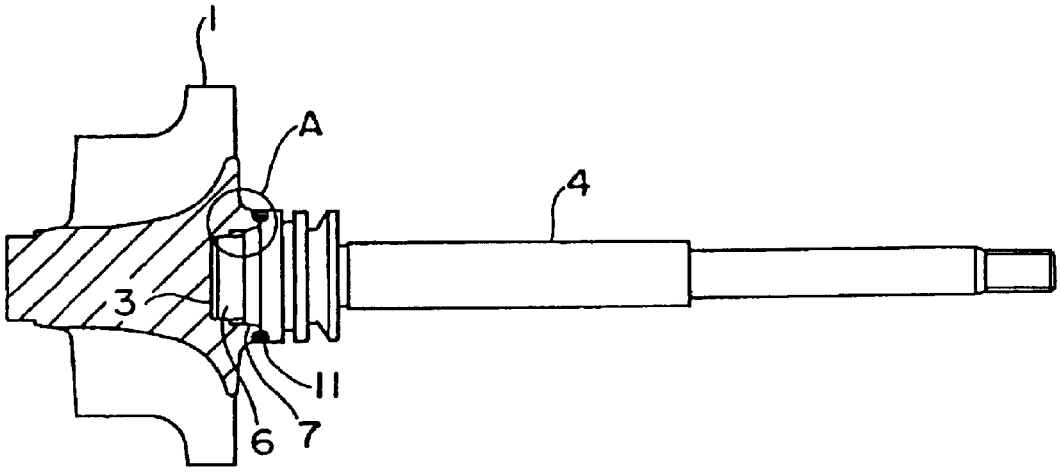
FIG. 3 is a diagram showing a state in which the turbine wheel and the turbine shaft are joined together.
Figure 4:
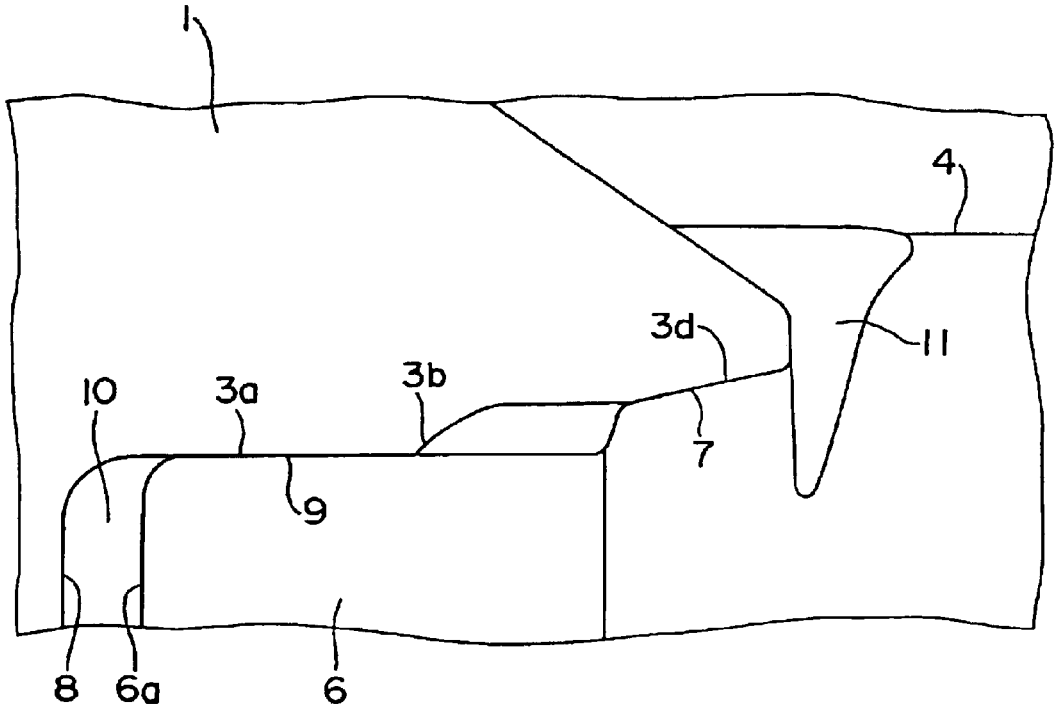
FIG. 4 is an enlarged view of portion A of FIG. 3, showing the joint portion of the turbine wheel and the turbine shaft.

After cleaning the turbine wheel 1 and the turbine shaft 4, the head portion 5 of the turbine shaft 4 is inserted into the fitting hole 3 of the turbine wheel 1. At this time, as shown in FIGS. 3 and 4, the insertion portion 6 is fitted into the fitting hole 3 to realize a so-called faucet engagement; the forward end 6*a*, however, does not abut the bottom 8 of the fitting hole 3, leaving a small gap 10 between the forward end of the insertion portion 6 and the bottom 8 of the fitting hole 3. The gap 10 is provided for the purpose of reducing, if to a small degree, the heat transmission from the turbine wheel 1 to the turbine shaft 4 during operation of the turbocharger.

The tapered abutment portion 7 of the turbine shaft 4 abuts the tapered edge portion 3*d* in the inner periphery of the fitting hole 3; since the tapered portions are brought into close contact with each other, positioning of the turbine shaft 4 in the direction of the axis L is effected automatically, the two components being guided coaxially. Thus, the turbine wheel 1 and the turbine shaft 4 are brought into close contact with each other in a stable manner without involving any play.

In addition, the insertion portion 6 reaches the innermost small diameter portion of the fitting hole 3, and the peripheral side surface of the insertion portion 6 and the inner peripheral wall 3*a* with small diameter are brought into contact with each other, so that the axial abutment portion 7 and the tapered edge portion 3*d* are brought into close contact with each other in a very stable manner.

The positional relationship between the insertion portion 6 and the axial abutment portion 7 is not restricted to that of this embodiment. For example, it is also possible to provide a tapered portion in the innermost portion of the fitting hole 3 and use this portion as the axial abutment portion, with the insertion portion for stabilizing the close contact being situated on the opening side of the fitting hole 3. By positioning the tapered axial abutment portion 7 as near to the opening of the fitting hole 3 as possible, the joint error in the axial direction can be easily reduced, thereby achieving an improvement in the joining accuracy of the turbine wheel 1 and the turbine shaft 4.

(Welding)

As shown in FIGS. 3 and 4, when the insertion portion 6 of the turbine shaft 4 is inserted into the fitting hole 3 of the turbine wheel 1 to bring the axial abutment portion 7 into close contact with the tapered edge portion 3*d*, the tapered peripheral edge portion 3*d* of the fitting hole 3 of the turbine wheel 1 and the protrusion 5 provided next to the axial abutment portion 7 of the turbine 4 are opposed to each other, with a small gap being generated therebetween. The tapered peripheral edge portion 3*d* and the protrusion 5 are joined together by electron beam welding. Since the melting point of the turbine shaft 4 is lower than that of the material of the turbine wheel 1, the protrusion 5 is melted earlier than the peripheral edge portion 3*d* of the opening. FIG. 4 shows a fused welding portion 11. This welding is performed on the entire periphery of the tapered peripheral edge portion 3*d* and the protrusion 5, and the turbine wheel 1 and the turbine shaft 4 are integrally joined together. As shown in the drawing, the fused portion 11 is at a position separate from the axial abutment portion 7. Due to this fusion, the turbine shaft 4 is prevented from becoming shorter, thus preventing change in the axial length of the shaft. The accuracy in the axial direction of the turbine shaft 4 is maintained by the axial abutment portion 7.

The generation of bending stress due to heat in the turbine shaft 4 as a result of the welding performed on the entire periphery of the tapered peripheral edge portion 3*d* and the protrusion 5 can be coped with through control in a direction perpendicular to the rotation axis direction by the axial abutment portion 7, so that it is possible to prevent the turbine shaft 4 from being bent by welding.

Figure 8:
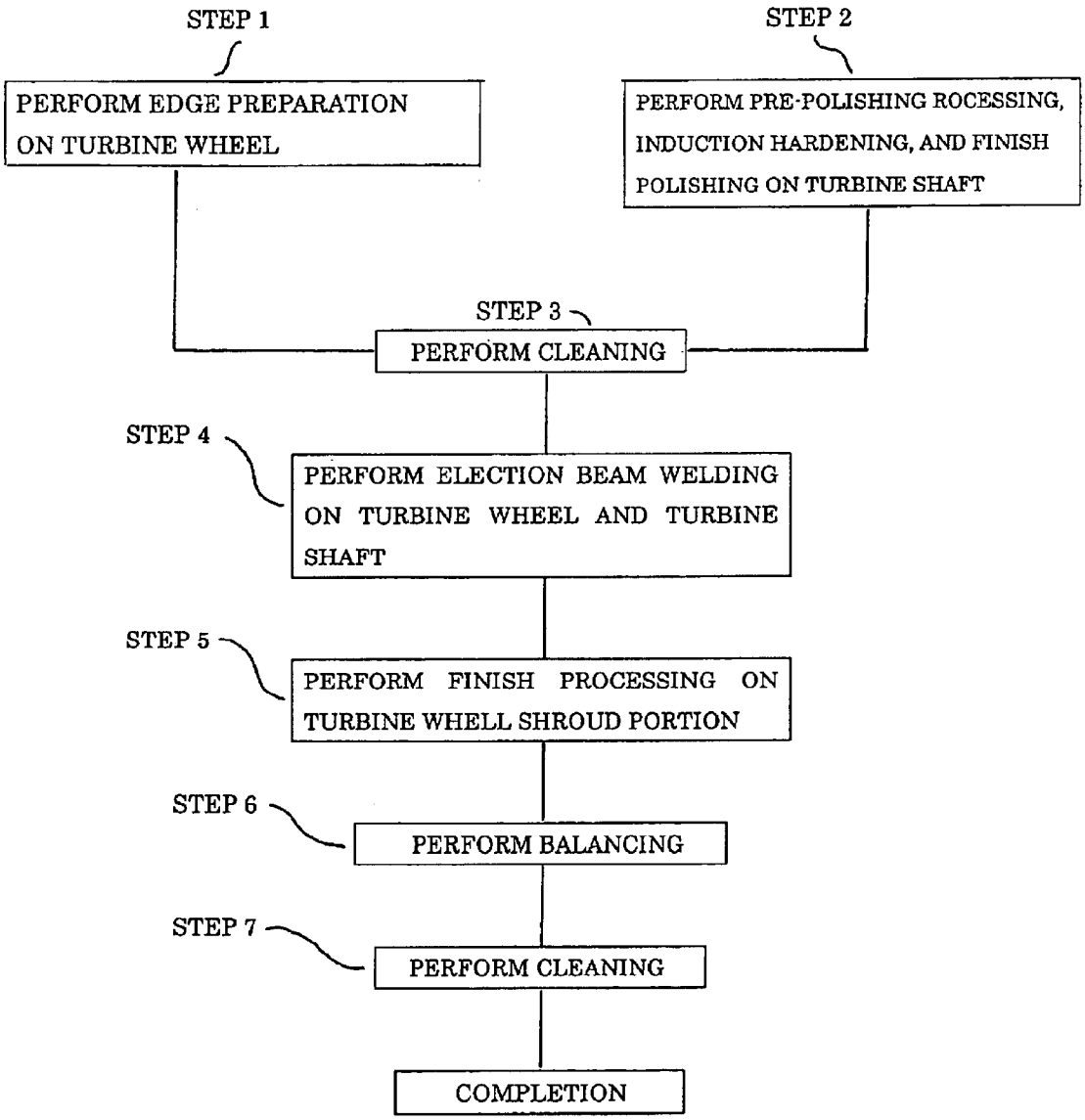
FIG. 8 is a flowchart showing a process for joining together a turbine wheel and a turbine shaft.
Figure 9:
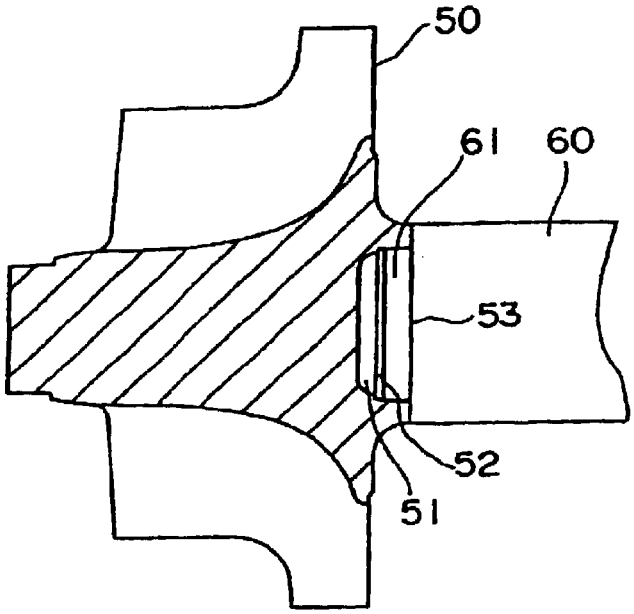
Conventional Art F I G. 9
FIG. 9 is a diagram showing a conventional example in which a turbine wheel and a turbine shaft are joined together.
Figure 10:
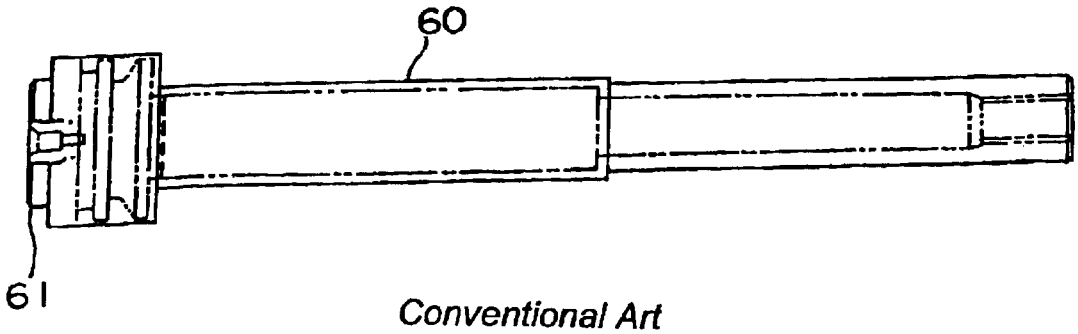
Conventional Art F I G. 10
FIG. 10 is a diagram showing how a conventional turbine shaft is processed.

In the following, the process for joining together the turbine wheel 1 and the turbine shaft 4 will be illustrated with reference to the flowchart of FIG. 8.

In step 1, edge preparation is performed on the turbine wheel 1. Here, the fitting hole 3 into which the axial abutment portion 7 is fitted is provided, and a plurality of blades 2 are formed in the outer periphery, thus substantially completing the turbine wheel.

In step 2, the turbine shaft 4 is prepared by forming a steel material into a shaft, regulating the configuration of the shaft and the head portion, imparting hardness to the whole through induction hardening, and performing finish polishing thereon.

Next, in step 3, the turbine wheel 1 and the turbine shaft 4 are cleaned.

After the cleaning, in step 4, the turbine wheel 1 and the turbine shaft 4 are joined to each other by electron beam welding.

In step 5, finish processing is performed on the shroud portion of the turbine wheel 1.

Next, in step 6, the balance of the whole is adjusted, and, in step 7, cleaning is performed thereon for completion.

As described above, in accordance with this embodiment, the axial abutment portion 7 is provided in a part other than the portion fused by welding, so that it is possible to prevent axial dimensional change in the turbine shaft 4.

Further, solely by bringing the axial abutment portion 7 and the tapered peripheral edge portion 3*d* into close contact with each other, in other words, solely by inserting the insertion portion 6 into the fitting hole 3 to abut the turbine wheel and the turbine shaft 4 against each other, the turbine wheel 1 and the turbine shaft 4 are guided so as to be arranged coaxially, whereby accuracy in coaxiality can be easily secured.

Further, by providing the insertion portion 6 having a fixed diameter along with the axial abutment portion 7, the axial abutment portion 7 and the tapered peripheral edge portion 3*d* are held in close contact with each other in a very stable manner, whereby the turbine shaft 4 is little subject to axial deviation.

At the same time, due to the axial abutment portion 7, movement of the turbine shaft 4 is also restricted in a direction perpendicular to the axial direction, so that it is possible to effectively prevent bending of the turbine shaft 4 due to the heat at the time of welding.

Further, the step of polishing the turbine shaft after joining it to the turbine wheel 1 for the regulation of its shape, is eliminated, whereby it is possible to reduce the processing work and difficulty involved.

While in the embodiment described above the turbine shaft and the turbine wheel are joined together, it goes without saying that the same technique is applicable to the connection of the turbine shaft with the compressor wheel. Further, there is no particular limitation regarding the means for the connection; it is possible to adopt a welding process other than electron beam welding or some other connecting means.

Embodiment 2

Figure 5:
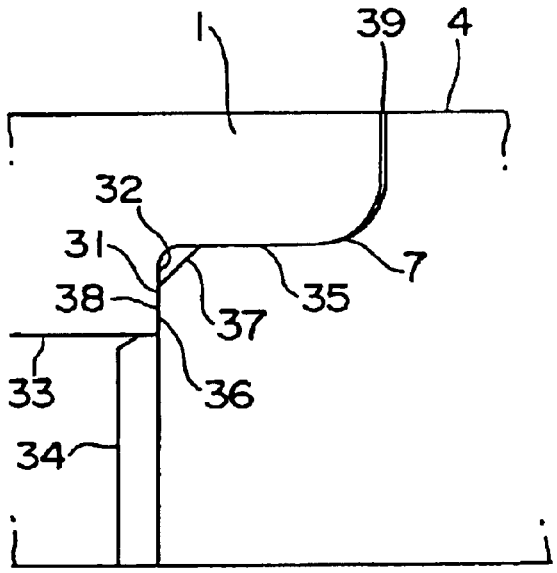
FIG. 5 is a diagram showing the joint portion of the turbine wheel and the turbine shaft according to another embodiment.

While in Embodiment 1 the gap 10 exists between the insertion portion 6 and the bottom 8 of the fitting hole 3, it is also possible to adopt a construction in which there is provided an abutment portion 38 as shown in FIG. 5.

In the embodiment shown in FIG. 5, a step portion 31 is formed on an inner peripheral wall 30 of the fitting hole 3, and this step portion 31 has a surface 32 perpendicular to the rotation axis of the turbine shaft 4. The forward end portion beyond the step portion 31 (the left-hand portion in the drawing) is formed as a small diameter portion 33.

The turbine shaft 4 has at its forward end a protrusion 34 to be inserted into the small diameter portion 33, and a step portion 36 is formed between the protrusion 34 and the outer peripheral portion 35 of the turbine shaft 4. The corner of the step portion 36 is beveled into a flat portion 37.

In this way, there is formed an abutment portion 38 where the step portion 31 of the fitting hole 3 and the step portion 36 of the turbine shaft 4 abut against each other when joining the turbine wheel 1 and the turbine shaft 4 to each other. When joining the two components, thus constructed, to each other by welding, a portion other than the abutment portion 38, in this case a welding portion 39 situated behind the abutment portion 38 (on the right-hand side in FIG. 5), is fused. Therefore, the abutment portion 38 is not fused, which, in synergy with the tapered axial abutment portion 7, more reliably helps to prevent change in dimension due to the axial contraction of the turbine shaft 4.

Embodiment 3

Figure 6:
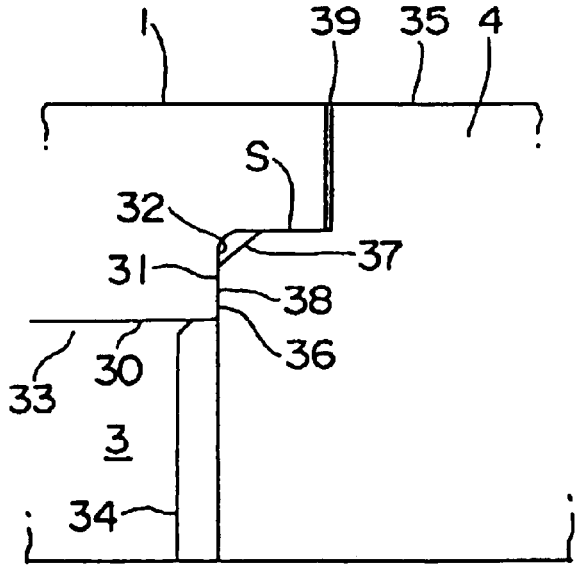
FIG. 6 is a diagram showing the joint portion of the turbine wheel and the turbine shaft according to still another embodiment.

As shown in FIG. 6, in this embodiment, in the connection between the turbine shaft 4 and the turbine wheel 1, the insertion portion 6 is inserted into the fitting hole 3 without providing a tapered axial abutment portion. A step portion 31 is formed on the inner peripheral wall 30 of the fitting hole 3, and the step portion 31 has a surface 32 perpendicular to the turbine shaft 4. The forward end portion beyond the step portion 31 (on the left-hand side in the drawing) is formed as the small diameter portion 33.

The turbine shaft 4 has at its forward end a protrusion 34 to be inserted into the small diameter portion 33, and a step portion 36 is formed between the protrusion 34 and the outer peripheral portion 35 of the turbine shaft 4. The corner of the step portion 36 is beveled into a flat portion 37.

In this way, there is formed an abutment portion 38 where the step portion 31 of the fitting hole 3 and the step portion 36 of the turbine shaft 4 abut against each other when joining the turbine wheel 1 and the turbine shaft 4 to each other. When joining them to each other by welding, a part other than the abutment portion 38, in this case a welding portion 39, is fused, whereby it is possible to prevent change in dimension due to axial contraction of the turbine shaft 4.

In this case, to coaxially arrange the turbine wheel 1 and the turbine shaft 4, a gap S between the inner peripheral wall 30 of the fitting hole 3 and the outer peripheral wall 35 of the turbine shaft 4 is made as small as possible, and the turbine shaft 4 is forced into the fitting hole 3, whereby it is possible to arrange them coaxially, with practically no error involved.

INDUSTRIAL APPLICABILITY

The present invention is applicable to the manufacturing of a turbocharger device for an internal combustion engine, making it possible to provide a high quality turbocharger device with an improved joining accuracy for the turbine wheel and the turbine shaft.

What is claimed is:

1. A turbocharger turbine shaft joining method for joining together a wheel and a turbine shaft, the method comprising:

obtaining a wheel having a fitting hole into which one end portion of a turbine shaft is to be inserted for fixation, wherein at least a part of an inner peripheral wall of the fitting hole of the wheel is tapered so as to be reduced in diameter inwardly from the opening of the fitting hole;

positioning the turbine shaft in a rotation axis of the wheel, wherein at the one end of the turbine shaft to be joined to the wheel are a tapered axial abutment portion capable of being brought into close contact with the tapered inner peripheral wall and an insertion portion with a fixed diameter to be inserted into the fitting hole; and joining and fixing the wheel and the turbine shaft to each other so as to be coaxial in the rotation axis.

2. A turbocharger turbine shaft joining method according to claim 1, characterized in that the turbine shaft is provided with an abutment portion abutting against a surface provided in the fitting hole and restricting axial movement of the turbine shaft at the time of welding.

3. A turbocharger turbine shaft joining method according to claim 2, characterized in that: an insertion portion with a fixed diameter is formed at one end of the turbine shaft; and an axial abutment portion connected to the insertion portion and tapered so as to gradually increase in diameter from the insertion portion is provided, both the insertion portion and the axial abutment portion being coaxially arranged.

4. A turbocharger turbine shaft joining method according to claim 2, characterized in that the wheel and the turbine shaft are welded to each other by fusing a part other than the axial abutment portion of the turbine shaft and the tapered inner peripheral wall of the wheel.

5. A turbine wheel for use in a joining method according to claim 2, characterized in that at least a part of the inner peripheral wall of the fitting hole into which one end portion of the turbine shaft is to be inserted is tapered so as to reduce in diameter inwardly from the opening of the fitting hole.

6. A turbine shaft for use in a joining method according claim 2, characterized in that provided at one end of the turbine shaft to be joined to the turbine wheel are a tapered axial abutment portion capable of being brought into close contact with the tapered inner peripheral wall of the fitting hole formed in the turbine wheel and an insertion portion with a fixed diameter to be inserted into the fitting hole.

7. A turbocharger turbine shaft joining method according to claim 1, characterized in that: an insertion portion with a fixed diameter is formed at one end of the turbine shaft; and an axial abutment portion connected to the insertion portion and tapered so as to gradually increase in diameter from the insertion portion is provided, both the insertion portion and the axial abutment portion being coaxially arranged.

8. A turbine wheel for use in a joining method according claim 7, characterized in that at least a part of the inner peripheral wall of the fitting hole into which one end portion of the turbine shaft is to be inserted is tapered so as to reduce in diameter inwardly from the opening of the fitting hole.

9. A turbine shaft for use in a joining method according claim 7, characterized in that provided at one end of the turbine shaft to be joined to the turbine wheel are a tapered axial abutment portion capable of being brought into close contact with the tapered inner peripheral wall of the fitting hole formed in the turbine wheel and an insertion portion with a fixed diameter to be inserted into the fitting hole.

10. A turbocharger turbine shaft joining method according to claim 1, characterized in that the wheel and the turbine shaft are welded to each other by fusing a part other than the axial abutment portion of the turbine shaft and the tapered inner peripheral wall of the wheel.

11. A turbine wheel for use in a joining method according to claim 1, characterized in that at least a part of the inner peripheral wall of the fitting hole into which one end portion of the turbine shaft is to be inserted is tapered so as to reduce in diameter inwardly from the opening of the fitting hole.

12. A turbine shaft for use in a joining method according to claim 1, characterized in that provided at one end of the turbine shaft to be joined to the turbine wheel are a tapered axial abutment portion capable of being brought into close contact with the tapered inner peripheral wall of the fitting hole formed in the turbine wheel and an insertion portion with a fixed diameter to be inserted into the fitting hole.

13. A turbine shaft according to claim 12, characterized in that: an insertion portion with a fixed diameter is formed at one end of the turbine shaft; and a tapered portion connected to the insertion portion and gradually increasing in diameter is provided, the insertion portion and the tapered portion being arranged coaxially.

14. A turbocharger turbine shaft joining method for joining together a wheel and a turbine shaft, the method comprising:

obtaining a wheel having a fitting hole into which one end portion of a turbine shaft is to be inserted for fixation;

positioning a turbine shaft in a rotation axis of the wheel; and inserting an insertion portion with a fixed diameter at one end of the turbine shaft to be joined to the wheel into the fitting hole, wherein on the insertion portion is an abutment portion abutting against a surface formed in the fitting hole and restricting axial movement of the turbine shaft to thereby prevent axial movement of the turbine shaft at the time of welding.

* * * * *